US008141363B2

(12) United States Patent
Khan et al.

(10) Patent No.: US 8,141,363 B2
(45) Date of Patent: Mar. 27, 2012

(54) APPARATUS AND METHOD FOR COOLING NOZZLES

(75) Inventors: Abdul Rafey Khan, Greenville, SC (US); Christian Xavier Stevenson, Inman, SC (US); Thomas Edward Johnson, Greer, SC (US)

(73) Assignee: General Electric Company, Schenectady, NY (US)

( * ) Notice: Subject to any disclaimer, the term of this patent is extended or adjusted under 35 U.S.C. 154(b) by 308 days.

(21) Appl. No.: 12/575,671

(22) Filed: Oct. 8, 2009

(65) Prior Publication Data

US 2011/0083442 A1 Apr. 14, 2011

(51) Int. Cl.
*F02C 1/00* (2006.01)

(52) U.S. Cl. ..... 60/740; 60/737; 239/132.3

(58) Field of Classification Search ..... 60/737, 60/740, 742, 746–748; 239/132.3, 132.5, 239/403–405; 431/12, 159, 171, 174, 175
See application file for complete search history.

(56) References Cited

U.S. PATENT DOCUMENTS 2,613,737 A * 10/1952 Schwietert ..... 239/419
3,763,650 A * 10/1973 Hussey et al. ..... 60/39.463
3,777,983 A * 12/1973 Hibbins ..... 239/422
4,105,163 A 8/1978 Davis, Jr. et al.
4,292,801 A 10/1981 Wilkes et al.
4,708,293 A * 11/1987 Graziadio et al. ..... 239/427
5,146,741 A * 9/1992 Sood ..... 60/39.55
5,351,489 A * 10/1994 Okamoto et al. ..... 60/740
5,400,968 A 3/1995 Sood
5,452,857 A * 9/1995 Furuse et al. ..... 239/405
5,467,926 A 11/1995 Idleman et al.
6,059,566 A * 5/2000 Cummings, III ..... 431/353
6,178,752 B1 * 1/2001 Morford ..... 60/737
6,363,724 B1 * 4/2002 Bechtel et al. ..... 60/737
7,036,753 B2 * 5/2006 Huffman ..... 239/432
7,828,227 B2 * 11/2010 Brown ..... 239/88
7,861,528 B2 * 1/2011 Myers et al. ..... 60/737
2006/0191268 A1 8/2006 Widener et al.
2009/0224082 A1 * 9/2009 MacMillan et al. ..... 239/596

* cited by examiner

*Primary Examiner* — Louis Casaregola
*Assistant Examiner* — Phutthiwat Wongwian
(74) *Attorney, Agent, or Firm* — Dority & Manning, P.A.

(57) ABSTRACT

A nozzle includes a nozzle body and a cavity defined at least in part by the nozzle body. A plenum extends through the nozzle body into the cavity. At least one passage through the plenum provides fluid communication between the plenum and the cavity. Orifices through the nozzle body and circumferentially spaced around the nozzle body provide fluid communication through the nozzle body. A method for cooling a face of a nozzle having a nozzle body that defines a cavity includes flowing a fuel through the cavity and inserting a plenum through the nozzle body into the cavity. The method further includes flowing a fluid through the plenum so that the fluid impinges on the face of the nozzle to remove heat.

18 Claims, 5 Drawing Sheets

APPARATUS AND METHOD FOR COOLING NOZZLES

FIELD OF THE INVENTION

The present invention generally involves a system and method for cooling nozzles in a combustor. In particular, the present invention impinges a fluid on a nozzle surface to remove heat from the nozzle surface.

BACKGROUND OF THE INVENTION

Gas turbines are widely used in commercial operations for power generation. FIG. 1 illustrates a typical gas turbine 10 known in the art. As shown in FIG. 1, the gas turbine 10 generally includes a compressor 12 at the front, one or more combustors 14 around the middle, and a turbine 16 at the rear. The compressor 12 and the turbine 16 typically share a common rotor 18. The compressor 12 progressively compresses a working fluid and discharges the compressed working fluid to the combustors 14. The combustors 14 inject fuel into the flow of compressed working fluid and ignite the mixture to produce combustion gases having a high temperature, pressure, and velocity. The combustion gases exit the combustors 14 and flow to the turbine 16 where they expand to produce work.

FIG. 2 provides a simplified cross-section of a combustor 20 known in the art. A casing 22 surrounds the combustor 20 to contain the compressed working fluid from the compressor 12. Nozzles 24 are arranged in an end cover 26, for example, with primary nozzles 28 radially arranged around a secondary nozzle 30 as shown in FIG. 2. A liner 32 downstream of the nozzles 28, 30 defines an upstream chamber 34 and a downstream chamber 36 separated by a throat 38. The compressed working fluid from the compressor 12 flows between the casing 22 and the liner 32 to the primary 28 and secondary 30 nozzles. The primary 28 and secondary 30 nozzles mix fuel with the compressed working fluid, and the mixture flows from the primary 28 and secondary 30 nozzles into the upstream 34 and downstream 36 chambers where combustion occurs.

During full speed base load operations, the flow rate of the fuel and compressed working fluid mixture through the primary 28 and secondary 30 nozzles is sufficiently high so that combustion occurs only in the downstream chamber 36. During reduced power operations, however, the primary nozzles 28 operate in a diffusion mode in which the flow rate of the fuel and compressed working fluid mixture from the primary nozzles 28 is reduced so that combustion of the fuel and the compressed working fluid mixture from the primary nozzles 28 occurs in the upstream chamber 34.

Lower reactivity fuels, such as natural gas, typically have lower flame speeds. Due to lower natural gas flame speed, the flow rate of the fuel and compressed working mixture from the primary nozzles 28 operated in diffusion mode is sufficiently high so that combustion in the upstream chamber 34 occurs at a sufficient distance from the primary nozzles 28 to prevent the combustion from excessively heating and/or melting the primary nozzles 28. However, higher reactivity fuels, such as synthetic gas, hydrogen, carbon monoxide, ethane, butane, propane, or mixtures of higher reactivity hydrocarbons, typically have higher flame speeds. Increased flame speed of the higher reactivity fuels moves the combustion in the upstream chamber 34 closer to the primary nozzles 28. Local flame temperature under diffusion mode operation in the upstream chamber 34 can be much greater than the melting point of the primary nozzle 28 materials. As a result, primary nozzles 28 operated in diffusion mode may experience excessive heating, resulting in premature and/or catastrophic failure.

Therefore the need exists for an improved fuel flow system through the nozzles that can cool the nozzles and prevent the nozzles from melting.

BRIEF DESCRIPTION OF THE INVENTION

Aspects and advantages of the invention are set forth below in the following description, or may be obvious from the description, or may be learned through practice of the invention.

One embodiment within the scope of the present invention is a fuel nozzle. The fuel nozzle includes a rear wall, a front wall downstream of the rear wall, and a side wall between the rear wall and the front wall. An annular cavity is defined at least in part by the rear wall, front wall, and side wall. A plenum extends through the rear wall into the annular cavity, and at least one passage through the plenum provides fluid communication between the plenum and the annular cavity. A plurality of orifices through the side wall and circumferentially spaced around the side wall provide fluid communication through the side wall.

Another embodiment within the scope of the present invention is a fuel nozzle that includes a nozzle body and a cavity defined at least in part by the nozzle body. A plenum extends through the nozzle body into the cavity. The nozzle further includes at least one passage through the plenum that provides fluid communication between the plenum and the cavity. A plurality of orifices through the nozzle body and circumferentially spaced around the nozzle body provide fluid communication through the nozzle body.

An alternate embodiment within the scope of the present invention is a method for cooling a face of a nozzle. The nozzle includes a nozzle body that defines a cavity. The method includes flowing a fuel through the cavity and inserting a plenum through the nozzle body into the cavity. The method further includes flowing a fluid through the plenum so that the fluid impinges on the face of the nozzle to remove heat.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
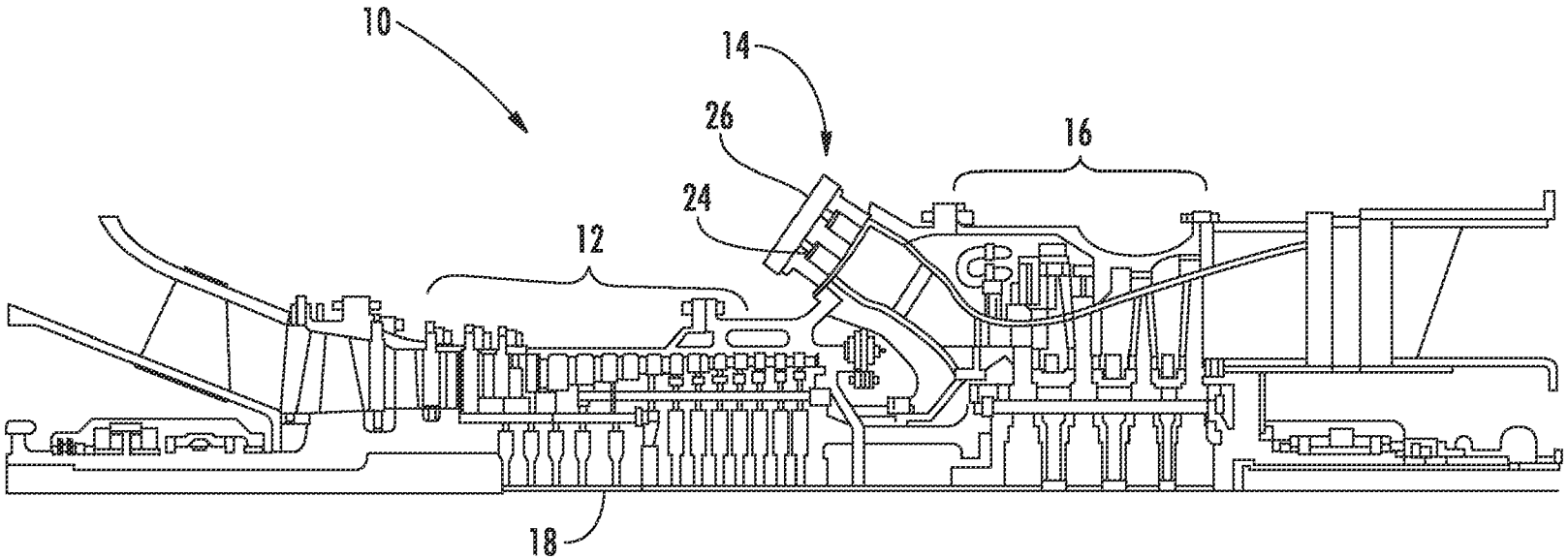
FIGURE 1 (PRIOR ART)
FIG. 1 shows a simplified cross-section of a gas turbine known in the art.
Figure 2:
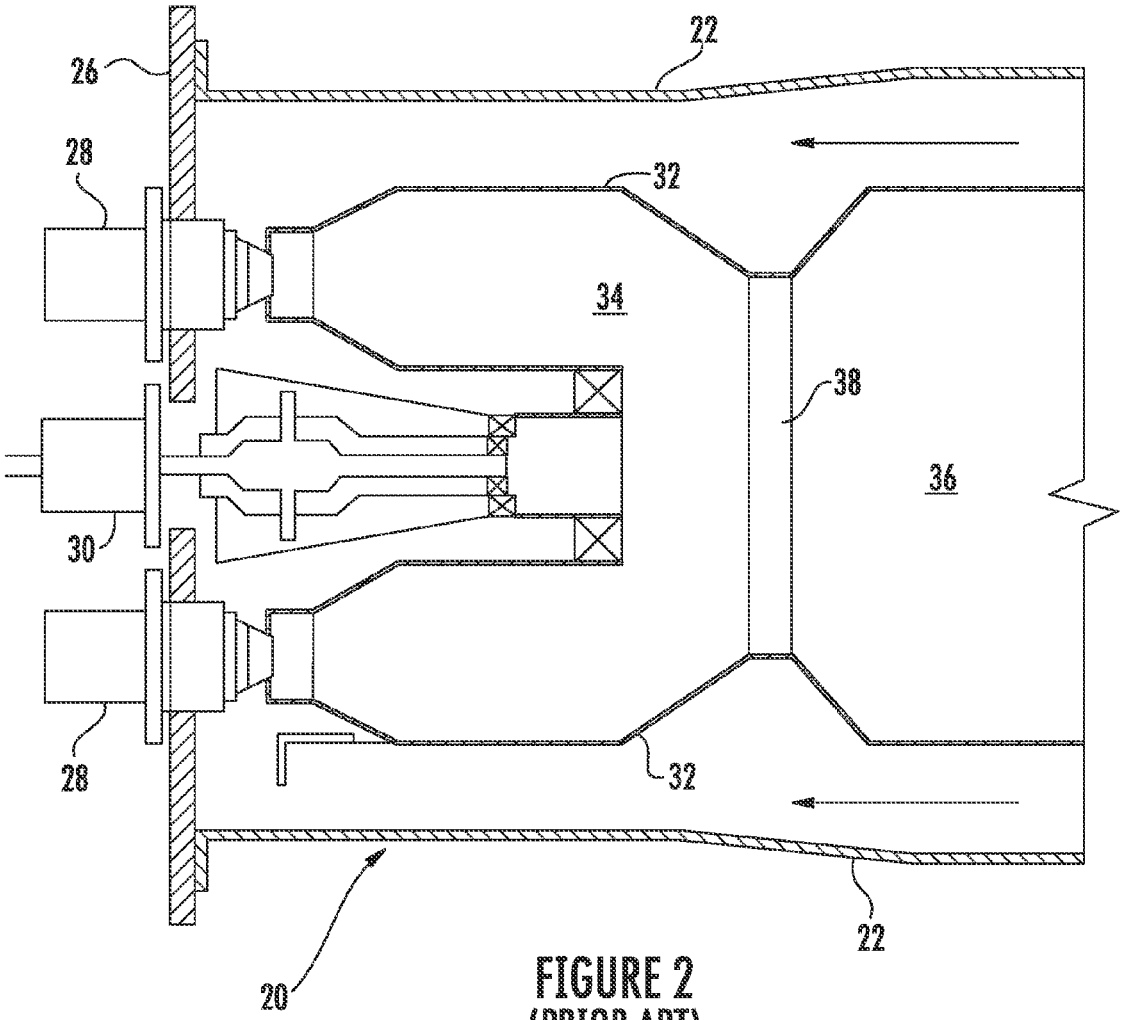
FIGURE 2 (PRIOR ART)
FIG. 2 shows a simplified cross-section of a combustor known in the art.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 3:
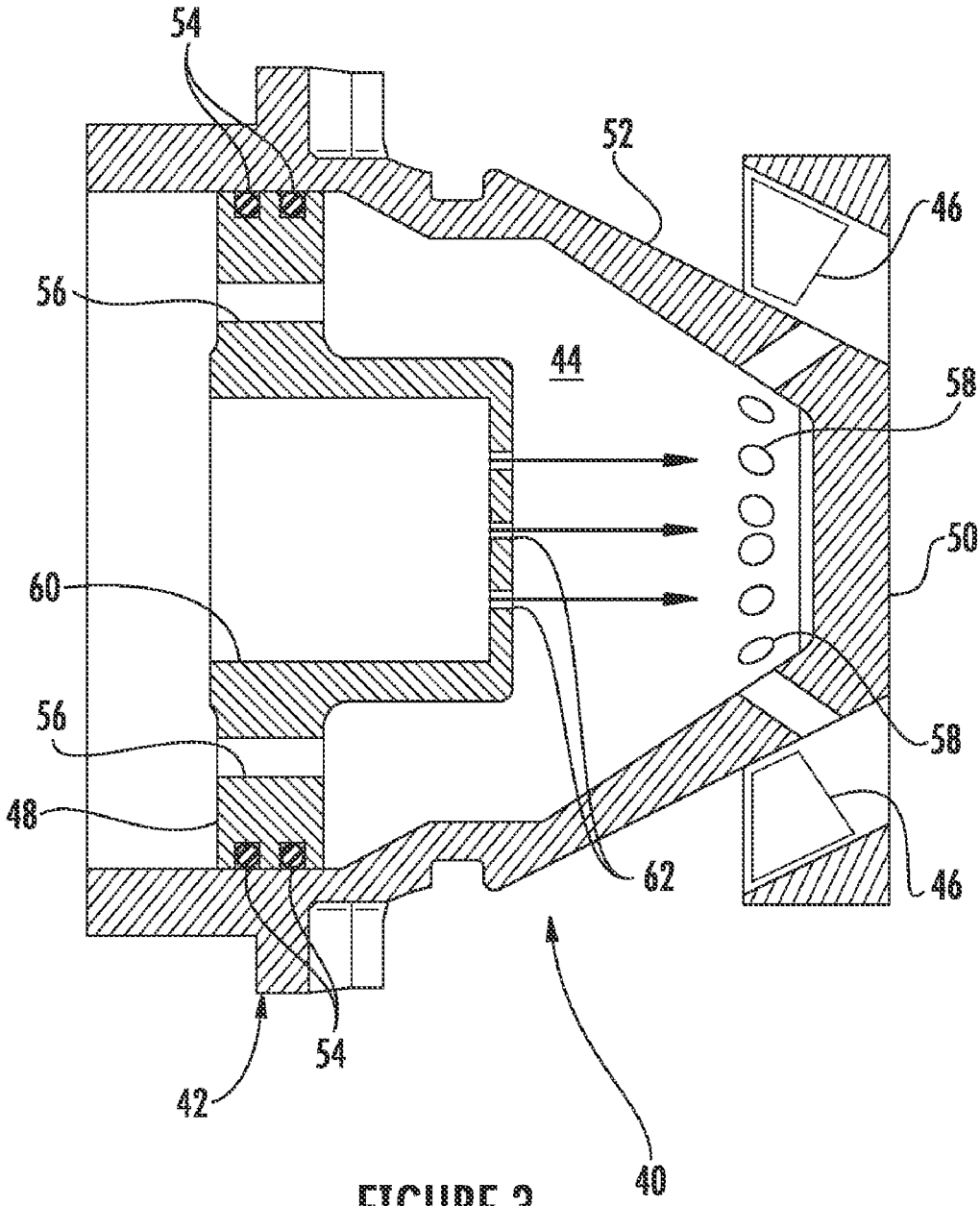
FIG. 3 shows a cross-section of a nozzle according to one embodiment of the present invention.

FIG. 3 shows a cross-section of a nozzle 40 according to one embodiment of the present invention. The nozzle 40 generally includes a nozzle body 42 with an annular cavity 44 on the inside and swirler vanes 46 arranged circumferentially around the downstream, outer surface of the nozzle body 42. Fuel supplied to the nozzle body 42 flows through the annular cavity 44 of the nozzle body 42 and exits in the vicinity of the swirler vanes 46. Compressed working fluid from the compressor 12 mixes with the fuel from the annular cavity 44 and flows from the nozzle 40 into the upstream combustion chamber 34.

The nozzle body 42 generally includes a rear wall 48, a front wall 50 downstream of the rear wall 48, and a side wall 52 between the rear wall 48 and the front wall 50. The rear 48, front 50, and side 52 walls may be of a unitary construction or one or more separate components, as shown in FIG. 3. The rear wall 48 may include seals 54, threading, washers, or equivalent structures for providing a seal between the rear wall 48 and the side wall 52. The rear wall 48 may also include one or more pre-orifices 56 that provide fluid communication through the rear wall 48. The front wall 50 is typically a continuous, solid surface, although alternative of embodiments within the scope of the present of invention may include additional orifices in the front wall 50 to provide a fluid communication through the front wall 50. The side wall 52 may include a plurality of orifices 58 or ports through the side wall 52 and circumferentially spaced around the side wall 52 to provide fluid communication through the side wall 52. The rear wall 48, front wall 50, and side wall 52 combine to partially define the annular cavity 44 inside the nozzle body 42.

A plenum 60 extends through the rear wall 48 into the annular cavity 44. The plenum 60 may be a separate and/or removable component from the rear wall 48, or the plenum 60 and the rear wall 48 may be a unitary construction, as shown in FIG. 3. The plenum 60 includes at least one passage 62 through the plenum 60 which provides fluid communication between the plenum 60 and the annular cavity 44. The passage 62 may be a single opening, or the passage may be one or more orifices at the downstream end of the plenum 60 proximate to the front wall 50. Fluid supplied to the plenum 60 may be any available fluid which may pass through the nozzle body 42 into the upstream chamber 34. For example, the fluid may be the same fuel or a different fuel supplied through the pre-orifices 56 in the rear wall 48. Alternatively, the fluid may be steam, water, compressed air, or any fluid that can freely pass through the nozzle body 42 and into the upstream chamber 34 without adversely affecting the combustion.

Fuel supplied to the nozzle 40 may thus flow into the annular cavity 44 through the pre-orifices 56 in the rear wall 48. In addition, a fluid, such as fuel, steam, water, or compressed air, may be supplied to the plenum 60 and flow through the passage 62 in the plenum 60 into the annular cavity 44. The passage 62 in the plenum 60 is proximate to the front wall 50 so that fluid flowing through the plenum 60 and through the passage 62 in the plenum 60 impinges on the front wall 50, thus cooling the front wall 50. The passage 62 through the plenum 60 may be within 1 inch and preferably within 0.5 inches of the front wall 50 to enhance the impingement cooling provided by the fluid through the passage 62 onto the front wall 50. To control cooling and attain an optimal front wall 50 thermal profile, fluid flow through the passage 62 may be adjusted by regulating the relative flow areas of the surrounding pre-orifices 56. As previously discussed, the fuel from the pre-orifices 56 in the rear wall 48 and the fluid from the passage 62 in the plenum 60 then flows out of the orifices 58 in the side wall 52 where it mixes with the compressed working fluid flowing across the swirler vanes 46.

Figure 4:
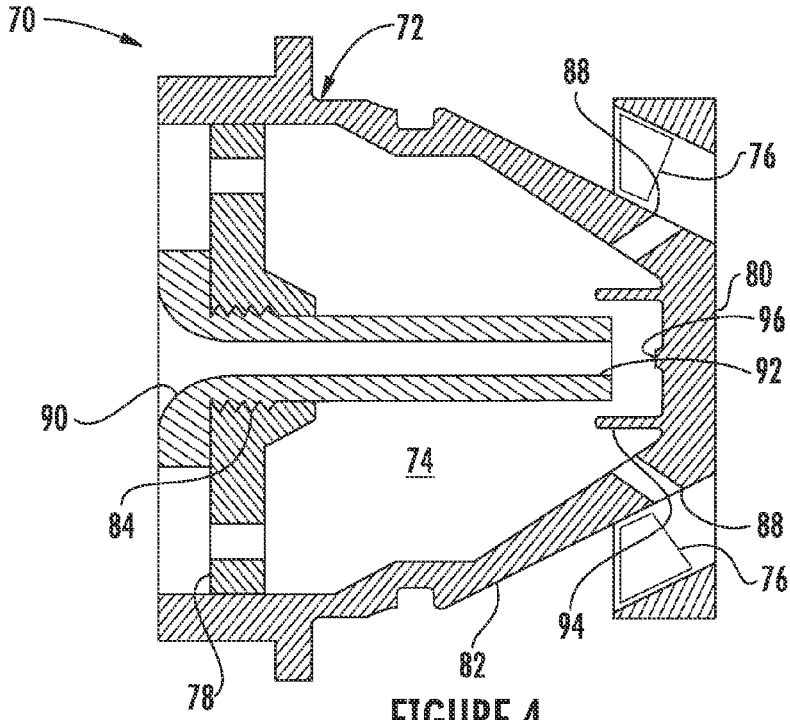
FIG. 4 shows a cross-section of a second embodiment of a nozzle within the scope of the present invention.

FIG. 4 provides a cross-section of a second embodiment of a nozzle 70 within the scope of the present invention. In this embodiment, the nozzle 70 again includes a nozzle body 72, annular cavity 74, and swirler vanes 76, as previously described with respect to the embodiment shown in FIG. 3. In addition, the nozzle body 72 includes a rear wall 78, a front wall 80 downstream of the rear wall 78, and a side wall 82 between the rear wall 78 and the front wall 80, as previously discussed with respect to the embodiment shown in FIG. 3. In the embodiment shown in FIG. 4, a removable plenum 90 extends through the rear wall into the annular cavity 74. The plenum 90 includes threads 84 which mate with corresponding threads 84 on the rear wall 78 to allow installation and removal of the plenum 90. In this embodiment, the plenum 90 includes a singular passage 92 at the downstream end of the plenum 90 which allows fluid communication through the plenum 90. Fluid flowing through the passage 92 in the plenum 90 impinges on the front wall 80 to cool the front wall 80 before mixing in the annular cavity 74 and exiting through orifices 88 in the side wall 82.

The embodiment shown in FIG. 4 further includes a circular baffle 94 connected to the front wall 80 and/or side wall 82 and a protrusion 96 on the front wall 80. The circular baffle 94 guides the fluid exiting the passage 92 after it impinges on the front wall 80 and promotes even distribution of the fluid in the annular cavity 74 before the fluid exits the annular cavity 74 through the orifices 88 in the side wall 82. The protrusion 96 on the front wall increases the surface area and disrupts the impinging flow of the fluid from the passage 92 onto the front wall 80 to inhibit the formation of a boundary layer on the front wall 80 which would reduce the impingement cooling provided by the fluid.

Figure 5:
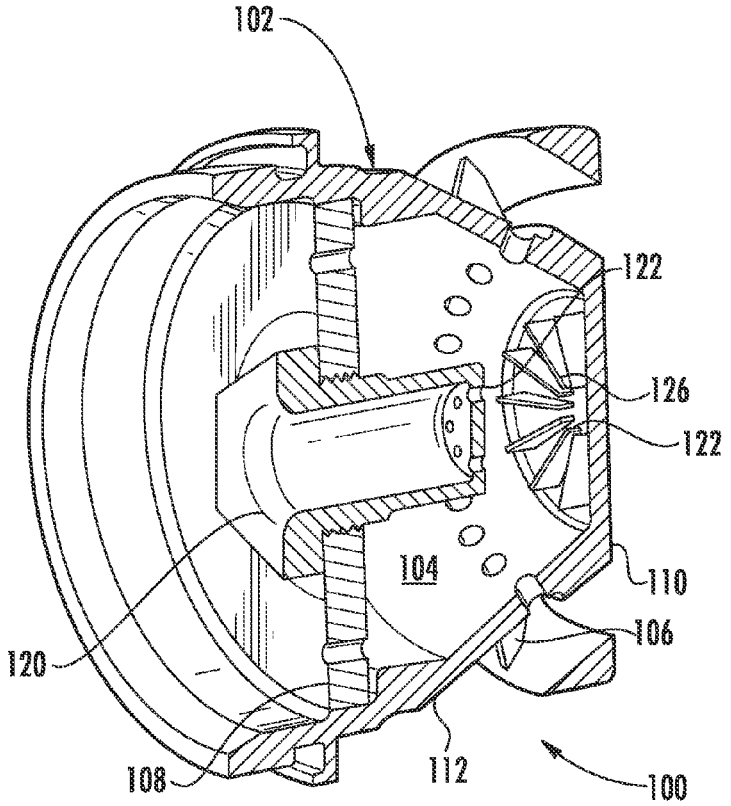
FIG. 5 shows a perspective cross-section of a third embodiment of a nozzle within the scope of the present invention.

FIG. 5 shows a third embodiment of a nozzle 100 within the scope of the present invention. In this embodiment, the nozzle 100 again includes a nozzle body 102, annular cavity 104, and swirler vanes 106, as previously described with respect to the embodiment shown in FIG. 3. In addition, the nozzle body 102 includes a rear wall 108, a front wall 110 downstream of the rear wall 108, and a side wall 112 between the rear wall 108 and the front wall 110, as previously discussed with respect to the embodiment shown in FIG. 3. A removable plenum 120 through the rear wall 108 includes a plurality of orifices 122 proximate the front wall 110 that provide fluid communication between the plenum 120 and the annular cavity 104. This embodiment also includes a plurality of protrusions on the front wall in the form of guide vanes 126. Fluid passing through the orifices 122 impinges on the front wall 110 to cool the front wall 110. The guide vanes 126 disperse the fluid radially through the annular cavity 104 to prevent the fluid from stagnating or forming a boundary layer on the front wall 110.

Figure 6:
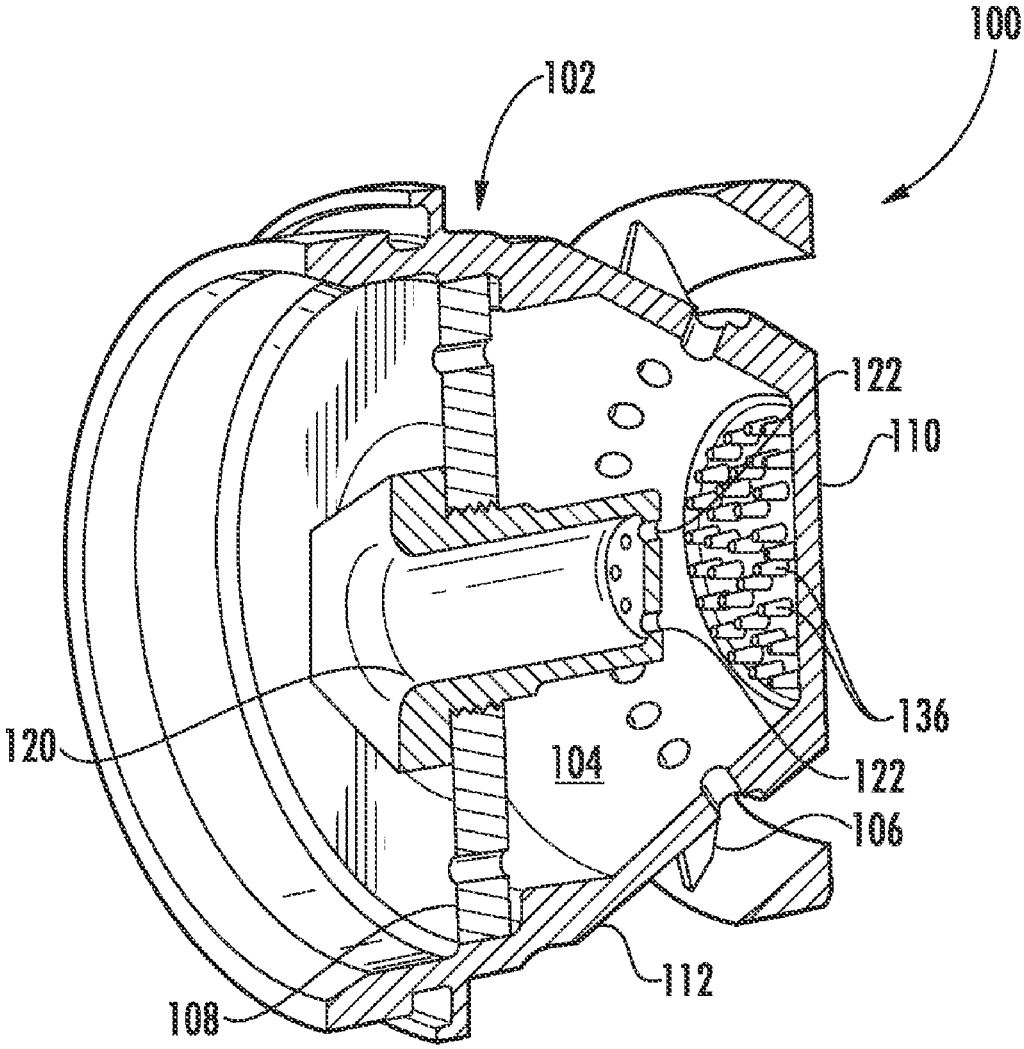
FIG. 6 shows a perspective cross-section of the nozzle shown in FIG. 5 with frusto-conical protrusions.

FIG. 6 shows a modification of the nozzle 100 shown in FIG. 5 within the scope of the present invention. In this embodiment, the protrusions on the front wall are in the form of cones or frusto-conical projections 136. In alternate embodiments, the protrusions may take the shape of cylinders, pyramids, or other geometric shapes. The frusto-conical projections 136 further enhance distribution of the fluid impinging on the front wall 110, provide increased surface area, prevent the fluid from forming a boundary layer on the front wall 110, and improve the impingement cooling provided by the fluid on the front wall 110.

The present invention may be used as an original design for a nozzle, or it may be used to modify an existing nozzle to provide impingement cooling to the nozzle. To modify an existing nozzle, the rear wall of the center body may be machined to provide an opening for inserting the plenum through the nozzle body into the cavity. Fluid may then be supplied to the plenum to flow through the plenum and impinge on the face of the nozzle body to remove heat from the front wall of the nozzle body. Additional modifications to an existing model may add protrusions or projections on the front wall of the nozzle body to distribute the fluid flowing across the nozzle body and enhance the impingement cooling provided by the fluid.

It should be appreciated by those skilled in the art that modifications and variations can be made to the embodiments of the invention set forth herein without departing from the scope and spirit of the invention as set forth in the appended claims and their equivalents.

What is claimed is:

1. A fuel nozzle, comprising:

a. a rear wall of the fuel nozzle;

b. a front wall downstream of the rear wall;

c. a side wall between the rear wall and the front wall;

d. an annular cavity defined at least in part by the rear wall, front wall, and side wall;

e. a plenum extending through the rear wall into the annular cavity;

f. a passage through the plenum, wherein the passage provides fluid communication between the plenum and the annular cavity;

g. a protrusion on the front wall between the front wall and the passage;

h. a baffle on the front wall surrounding at least a portion of the protrusion; and i. a plurality of orifices through the side wall and circumferentially spaced around the side wall, wherein the plurality of orifices provide fluid communication through the side wall.

2. The fuel nozzle of claim 1, wherein the passage through the plenum is within 1 inch of the front wall.

3. The fuel nozzle of claim 1, wherein the plenum is configured to allow a fluid flowing through the passage to cool the front wall.

4. The fuel nozzle of claim 1, wherein the protrusion on the front wall is a cone.

5. The fuel nozzle of claim 1, further including a plurality of pre-orifices through the rear wall, wherein the plurality of pre-orifices provide fluid communication through the rear wall.

6. The fuel nozzle of claim 1, further including a threaded engagement between the plenum and the rear wall.

7. The fuel nozzle of claim 1, further including a plurality of vanes circumferentially spaced around the side wall.

8. The fuel nozzle of claim 1, wherein the plenum is a fuel plenum.

9. The fuel nozzle of claim 1, wherein the baffle circumferentially surrounds the entire the protrusion.

10. The fuel nozzle of claim 1, wherein the baffle circumferentially surrounds the passage through the plenum.

11. A fuel nozzle, comprising:

a. a fuel nozzle body;

b. a cavity defined at least in part by the fuel nozzle body;

c. a plenum extending through the fuel nozzle body into the cavity;

d. a passage through the plenum, wherein the passage provides fluid communication between the plenum and the cavity;

e. a protrusion on a front wall of the fuel nozzle body between the front wall of the fuel nozzle body and the passage;

f. a baffle on the front wall surrounding at least a portion of the protrusion; and g. a plurality of orifices through a side wall of the nozzle body and circumferentially spaced around the fuel nozzle body, wherein the plurality of orifices provide fluid communication through the fuel nozzle body.

12. The fuel nozzle of claim 11, wherein the passage through the plenum is within 1 inch of the fuel nozzle body.

13. The fuel nozzle of claim 11, wherein the plenum is configured to allow a fluid flowing through the passage to cool the fuel nozzle body.

14. The fuel nozzle of claim 11, wherein the protrusion on the nozzle body is a cone.

15. The fuel nozzle of claim 11, further including a threaded engagement between the plenum and the fuel nozzle body.

16. The fuel nozzle of claim 11, further including a plurality of vanes circumferentially spaced around the fuel nozzle body.

17. The fuel nozzle of claim 11, wherein the baffle circumferentially surrounds the entire the protrusion.

18. The fuel nozzle of claim 11, wherein the baffle circumferentially surrounds the passage through the plenum.

* * * * *